US005440089A

United States Patent [19]

Prokop

[11] Patent Number: 5,440,089

[45] Date of Patent: Aug. 8, 1995

[54] FOOT/TABLE SWITCH LOCKOUT FOR ELECTRIC PUNCHES

[75] Inventor: Gary F. Prokop, Berwyn, Ill.

[73] Assignee: General Binding Corporation, Northbrook, Ill.

[21] Appl. No.: 369,326

[22] Filed: Jan. 6, 1995

Related U.S. Application Data

[63] Continuation of Ser. No. 57,895, May 7, 1993, abandoned.

[51] Int. Cl.[6] ..... H01H 1/52

[52] U.S. Cl. ..... 200/321; 200/318; 200/43.16

[58] Field of Search ..... 200/321, 318.1, 318, 200/43.16, 43.18, 61.58, 43.17, 329

[56] References Cited

U.S. PATENT DOCUMENTS 4,154,125 5/1979 Frank ..... 200/43.16

4,733,035 3/1988 Ohashi ..... 200/43.18

OTHER PUBLICATIONS

"Electric Punch, Models 111PM-1 & 112PM-1", Service Manual General Binding Corporation—no date.

*Primary Examiner*—J. Casimer Jacyna
*Assistant Examiner*—David J. Walczak
*Attorney, Agent, or Firm*—Hill, Steadman & Simpson

[57] ABSTRACT

A lockout assembly for an electric press alternately operable by either a foot switch or a table switch includes a lock knob. An annular switch ring is rotatably mounted beneath the lock knob. The annular switch ring includes a release opening. The switch ring is rotatable between a locking position in which the release opening is out of alignment with an actuating lever of the table switch, and a release position in which the release opening is in alignment with the actuating lever of the table switch.

18 Claims, 1 Drawing Sheet

FOOT/TABLE SWITCH LOCKOUT FOR ELECTRIC PUNCHES

This is a continuation of application Ser. No. 08/057,895, filed May 7, 1993.

TECHNICAL FIELD

The present invention relates to safety devices for electrically actuated punches, and particularly to switch lockouts for tabletop punches alternatively actuatable by either a foot switch or a table switch.

BACKGROUND OF THE INVENTION

Table top punch presses are known, and have found wide use in creating perforations in paper materials in preparation for binding. One such punch is the Model 111PM-1 manufactured by the General Binding Corporation.

These punches are typically operable by either a floor-mounted foot switch or a table switch. When the operator wants to use the foot switch, a lockout mechanism is typically provided to prevent actuation of the press by the table switch. The typical lockout mechanism is provided on the paper guide assembly on the press, and includes a locking clamp mounted beneath the paper guide screw assembly. In order to engage the lockout mechanism, the operator must loosen the paper guide screw assembly, then rotate the locking clamp into a position overlying the table switch actuation lever.

Known lockout mechanisms require two-handed operation, one hand to loosen the paper guide screw and another hand to rotate the locking clamp. Furthermore, the locking knobs of known lockout assemblies are susceptible to being inadvertently completely loosened, causing the entire switch and retaining bracket to fall into the machine.

SUMMARY OF THE INVENTION

It is an object of the present invention to provide a foot/table switch lockout assembly that overcomes the disadvantages of known assemblies by allowing one-handed operation of the lockout assembly while preventing the possibility of inadvertent disassembly of the guide assembly.

This and other objects are achieved by providing a lockout assembly for an electric press, alternatively operable by either a foot switch or a table switch, including a lock knob and an annular switch ring rotatably mounted beneath the lock knob. The switch ring includes a release opening, whereby the switch ring is rotatable between a locking position in which the release opening is out of alignment with an actuating lever of the table switch, and a release position in which the release opening is in alignment with the actuating lever of the table switch.

The switch ring can include a radially extending projection engageable by an operator to rotate the switch ring. The safety switch ring can be mounted on a paper guide of the punch.

Other objects and advantages of the present invention will be apparent upon reference to the accompanying description when taken in conjunction with the following drawings.

DESCRIPTION OF THE PREFERRED EMBODIMENT

Figure 1:
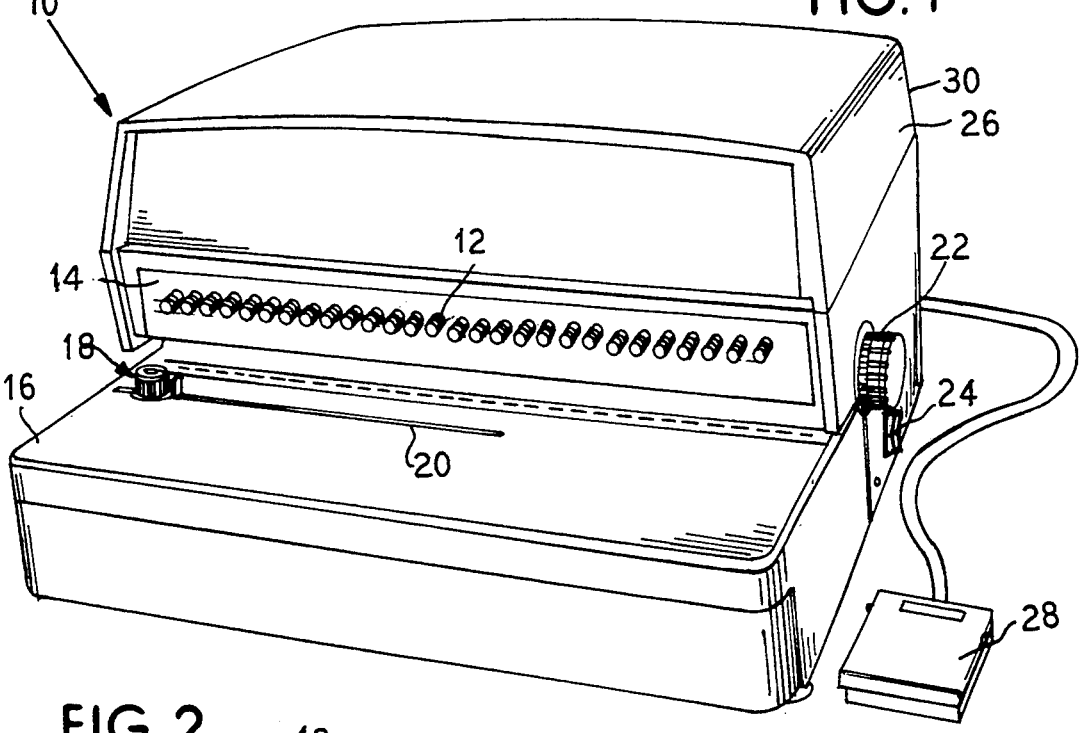
FIG. 1 illustrates a perspective view of an electric punch press constructed in accordance with the principles of the present invention.

As illustrated in FIG. 1, a table top electric punch press 10 includes a number of selector pins 12 arranged in a lower front panel 14 of the table top electric punch press 10. A punch table 16 is also provided, and includes a side guide assembly 18, longitudinally movable along a guide slot 20 formed in the punch table 16. A back gauge control knob 22 and a control switch 24 are provided on a side panel 26 of the table top electric punch press 10. A foot switch 28 is also provided, and is electrically connected to the table top electric punch press 10 through a back panel 30 of the table top electric punch press 10.

Generally, a table top electric punch press operates by supplying power to a motor when a main power switch is set in a FOOT or TABLE position. A centrifuge switch is provided in the motor, which prevents a solenoid from being energized and any punching from occurring until the motor has reached operating speed. When the motor has reached operating speed and the FOOT or TABLE switch is closed, the solenoid is energized through normally closed contacts. The solenoid then retracts a clutch pin, and a clutch is engaged. This transmits power to a pressure bar for punching when the pressure bar reaches the down point of a punching stroke. The contacts of an underarm switch are then closed, thereby energizing a relay coil, which de-energizes the solenoid. When the solenoid is de-energized, the clutch pin is extended to dis-engage the clutch. This completes the punching cycle, as discussed in General Binding Corporation's Service Manual for Electric Punch Models 111PM-1 & 112PM-1.

Figure 2:
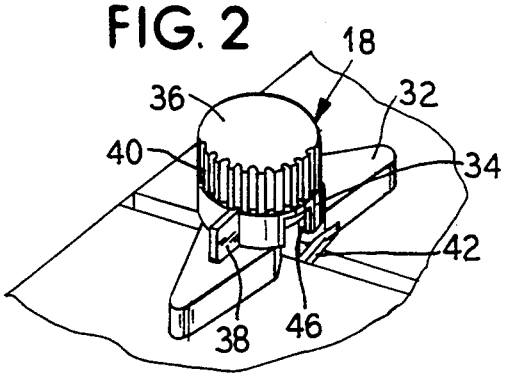
FIG. 2 illustrates a perspective view of a lockout assembly constructed in accordance with the principles of the present invention wherein a release opening is in alignment with an actuating lever of the table switch.

As illustrated in FIG. 2, the side guide assembly 18 includes a paper guide 32. The paper guide 32, a safety switch ring 34, and a lock knob 36 are coaxially mounted, as discussed in detail below with reference to FIG. 4. A projection 38 is provided on the safety switch ring 34 for selectively rotating the safety switch ring 34. Further, knurls 40 are provided along the perimeter of the lock knob 36. A table switch actuator 42 is also provided. The table switch actuator 42 is discussed in detail below with reference to FIG. 4. The punch table 16 includes a longitudinal slot 20. A guide projection 44, illustrated in FIG. 4, of the paper guide 32 is movably seated in slot 20 of the punch table 16.

Figure 3:
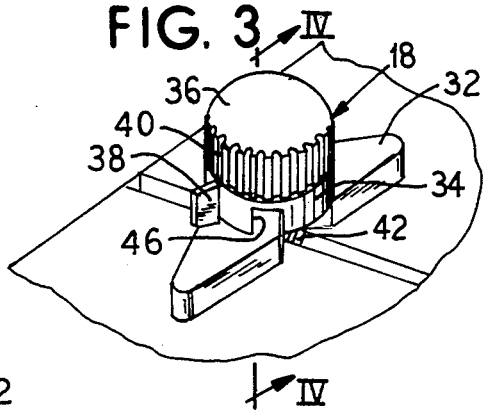
FIG. 3 illustrates a perspective view of a lockout assembly constructed in accordance with the principles of the present invention, wherein the release opening is out of alignment with the actuating lever of the table switch.

The safety switch 34 is rotatable between a release position, illustrated in FIG. 2, in which a release opening 46 is in alignment with the table switch actuator 42 and a locking position, illustrated in FIG. 3, in which the release opening 46 is out of alignment with the table switch actuator 42. The safety switch ring 34 is rotated between the locking position and the release position by moving the projection 38 in order to achieve the desired position.

Figure 4:
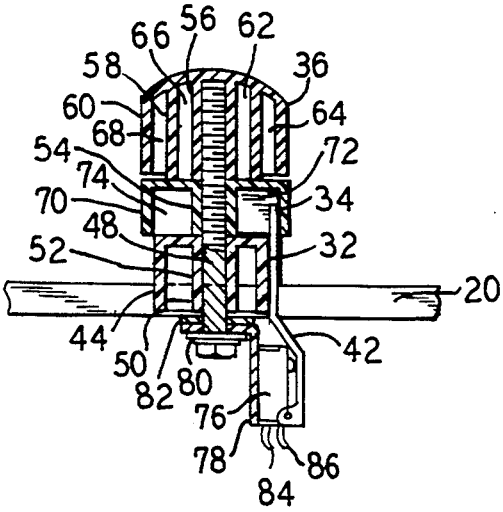
FIG. 4 illustrates a sectional view taken along the line IV—IV of FIG. 3.

As illustrated in FIG. 4, a central stud, or screw, 48 is provided for coaxially mounting the paper guide 32, the safety switch ring 34, and the lock knob 36. Each of the projection guide 44, paper guide 32, safety switch ring 34, and lock knob 36 include central annular members 50, 52, 54, and 56, respectively. The central annular members 50, 52, 54, and 56 surround the central stud 48 as illustrated in FIG. 4. Further, the lock knob 36 includes an intermediate annular member 58 and an outer shell 60. The intermediate annular member 58 is disposed between the central annular member 56 and the outer shell 60 of the lock knob 36. The outer shell 60 and the central and intermediate annular members 56, 58 are coaxially connected to one another by a plurality of radial webs 62, 64, 66, 68, etc.

In one embodiment, the intermediate annular member 58 and the central annular member 56 of the lock knob 36 are slightly longer than the outer shell 60, as illustrated in FIG. 4.

The safety switch ring 34 includes an outer wall, or shell, 70 in which the release opening 46 is formed. The outer wall 70 and the central annular member 54 of the safety switch ring 34 are connected together by a plurality of radial webs 72, 74, etc.

The projection guide 44 is disposed below the paper guide 32. The projection guide 44 can be integrally formed as part of the paper guide 32.

The table switch actuator, or lever, 42 is connected to a table switch 76. The table switch 76 is mounted to a switch retaining bracket 78. The switch retaining bracket 78 includes an aperture (not shown) adapted to receive the central stud 48. The switch retaining bracket 78 can be secured in position by providing, for example, a look washer 80 below the switch bracket 78 and a washer 82 above the switch bracket 78. The switch bracket 78 and the switch 76 are disposed below the punch table 16 within the housing of the electric table top punch 10. The lever 42 extends through slot 20 and above the punch table 16. The switch 76 includes leads 84, 86 for electrically connecting the table switch 76 to the operating electronics of the electric table top punch 10.

In accordance with the principles of the present invention, the position of the table switch enables operation of the punch 10 by either the table switch 76 or the foot switch 28. The table switch position and the safety switch ring position can both be altered by one-handed operation of the side guide, or lockout, assembly 18. For example, when the switch safety ring 34 is in a release position, in which the release opening 46 is in alignment with the table switch actuator 42 of the table switch 76, as illustrated in FIG. 2, the table switch 76 is activated by sliding an item to be punched, such as a sheet of paper, against the table switch actuator 42.

When the table switch actuator is retained in a locking position, in which the release opening 46 is out of alignment with the table switch actuator 42 of the table switch 76, the foot switch 28 is used to operate the punch 10. The table switch actuator 42 is pulled toward the safety switch ring 34 until it is radially inside the release opening 46. The safety switch ring 34 is then rotated, for example, by the projection 38, such that the release opening 46 is out of alignment with the table switch actuator 42 to achieve the locking position, illustrated in FIG. 3.

Although the present invention has been described with reference to a specific embodiment, those of skill in the art will recognize that changes may be made thereto without departing from the scope and spirit of the invention as set forth in the appended claims.

We claim as our invention:

1. A lockout assembly for an electric press alternatively operable by a table switch, said lockout assembly comprising the following:

a table switch having a pivotable actuating lever;

a lock knob; and an annular switch ring rotatably mounted beneath said lock knob surrounding said actuating lever in a locking position, said switch ring including a release opening;

whereby said switch ring is rotatable between said locking position in which said release opening is out of alignment with said actuating lever of the table switch, and a release position in which said release opening is in alignment with the actuating lever of the table switch allowing the actuating lever to pivot to escape said switch ring for manual actuation of the actuating lever.

2. A lockout assembly according to claim 1, wherein said switch ring includes a radially extending projection engageable by an operator to rotate said switch ring.

3. A lockout assembly according to claim 1, wherein said switch ring is adapted to be mounted on a paper guide of said press.

4. A lockout assembly according to claim 1, further comprising a plurality of knurls formed along a perimeter of said lock knob.

5. A lockout assembly according to claim 1, further comprising a paper guide and a central stud, wherein said lock knob, said switch ring, and said paper guide are coaxially mounted upon said central stud.

6. A lockout assembly for an electric press alternatively operable by a table switch, said lockout assembly comprising the following:

a table switch having an actuating lever;

a lock knob; and an annular switch ring rotatably mounted beneath said lock knob surrounding said actuating lever in a locking position, said switch ring including a release opening;

whereby said switch ring is rotatable between said locking position in which said release opening is out of alignment with said actuating lever of the table switch, and a release position in which said release opening is in alignment with the actuating lever of the table switch allowing the actuating lever to escape said switch ring for manual actuation; and member surrounding said central stud and an intermediate annular member between said shell and said central annular member, said outer shell and said central and intermediate annular members being coaxially connected to one another by a plurality of radial webs.

7. A lockout assembly according to claim 6, wherein said intermediate annular member and said central annular member are slightly longer than said outer shell.

8. A lockout assembly according to claim 7, wherein said switch ring includes an outer wall in which said release opening is formed and a central annular member surrounding said central stud, said outer wall and said central annular member being connected together by a plurality of radial switch ring webs.

9. A lockout assembly for an electric press alternatively operable by a table switch, said lockout assembly comprising the following:

a table switch having an actuating lever said actuating lever having a surface for manual actuating by a user to operate said electric press;

a lock knob;

a switch ring mounted beneath said lock knob, said switch ring surrounding said actuating lever in a locking position said switch ring including a release opening;

a paper guide mounted beneath said switch ring; and a central stud upon which said lock knob, said switch ring, and said paper guide are coaxially mounted;

whereby said switch ring is rotatable between a locking position in which said release opening is out of alignment with said actuating lever of the table switch, said switch ring restraining said actuating lever in said locking position, and a release position in which said release opening is in alignment with the actuating lever of the table for releasing said actuating lever from inside said switch ring to outside said switch ring through said release opening for manual actuation by a user thereof.

10. A lockout assembly for an electric press alternatively operable by a table switch, said lockout assembly comprising the following:

a table switch having an actuating lever;

a lock knob;

a switch ring mounted beneath said lock knob, said switch ring surrounding said actuating lever in a locking position said switch ring including a release opening;

a paper guide mounted beneath said switch ring; and a central stud upon which said lock knob, said switch ring, and said paper guide are coaxially mounted;

whereby said switch ring is rotatable between a locking position in which said release opening is out of alignment with said actuating lever of the table switch, and a release position in which said release opening is in alignment with the actuating lever of the table for releasing said actuating lever from said switch ring through said release opening;

wherein said lock knob includes an outer shell, a central annular member surrounding said central stud, and an intermediate annular member between said shell and said central annular member, said outer shell and said central and intermediate annular members being coaxially connected to one another by a plurality of radial webs.

11. A lockout assembly according to claim 10, wherein said intermediate annular member and said central annular member are slightly longer than said outer shell.

12. A lockout assembly according to claim 11, in which said switch ring includes an outer wall in which said release opening is formed and a central annular member surrounding said central stud, said outer wall and said central annular member being connected together by a plurality of radial webs.

13. A method for operating an electric press alternatively by a foot switch and a table switch comprising the steps of:

providing an annular switch ring having a release opening adapted to receive an actuating lever of a table switch;

rotating the switch ring to a locking position, in which said release opening is out of alignment with an actuating lever of the table switch;

operating said press via said foot switch;

rotating said switch ring to a release position in which said release opening is in alignment with said actuating lever of said table switch; and operating the electric press by the table switch.

14. A punch actuating assembly for an electric press comprising:

a paper supporting platform;

a table switch having an actuating lever actuatable by paper placed on said paper supporting surface;

a paper guide arranged adjacent said table switch for aligning paper to be punched on the paper supporting surface;

an annular switch ring rotatably mounted to said paper supporting surface and having a release opening, said switch ring alignable to said actuation lever and said actuating lever having a range of movement for said annular switch ring to receive said actuating lever through said release opening to be captured within said annular switch ring upon rotation thereafter of said annular switch ring, and said release opening registrable with said actuating lever to release said actuating lever from within said annular switch ring.

15. The assembly according to claim 14, further comprising a slot through said paper supporting platform, and a threaded fastener releasably holding said annular switch ring and said table switch to said paper supporting platform, but upon loosening, allows movement of said table switch and said annular switch ring along said slot to adjust for differing sizes of paper to be punched.

16. The assembly according to claim 15, wherein said threaded fastener includes a hand actuatable lock knob to loosen said threaded fastener and when tightened fixes the position of said table switch and annular switch ring and the rotary position of said annular switch ring.

17. The assembly according to claim 16, wherein said paper guide, said annular switch ring and said knob are held coaxially on said threaded fastener.

18. The assembly according to claim 14, further comprising a foot actuatable switch operable to operate the electric press when said table switch actuating lever is held within said annular switch ring.

* * * * *